United States Patent [19]

Rees

[11] Patent Number: 4,726,323

[45] Date of Patent: Feb. 23, 1988

[54] SOLID FUEL FIRED VAPOR GENERATOR

[75] Inventor: Karl Rees, Ruti, Switzerland

[73] Assignee: Sulzer Brothers Limited, Winterthur, Switzerland

[21] Appl. No.: 936,339

[22] Filed: Dec. 1, 1986

[30] Foreign Application Priority Data

Dec. 4, 1985 [CH] Switzerland ..... 5166/85

[51] Int. Cl.[4] ..... F22B 37/00

[52] U.S. Cl. ..... 122/6 A; 122/235 A; 122/235 K

[58] Field of Search ..... 122/235 A, 235 K, 6 A

[56] References Cited

U.S. PATENT DOCUMENTS

| | | | |
|---|---|---|---|
| 3,832,978 | 9/1974 | Brunner | 122/235 A |
| 4,075,979 | 2/1978 | Michel | 122/235 A |
| 4,537,156 | 8/1985 | Rees | 122/235 A X |

*Primary Examiner*—Edward G. Favors

*Attorney, Agent, or Firm*—Kenyon & Kenyon

[57] ABSTRACT

The vapor generator is formed with a flue of rectangular cross section and a funnel of four trapezoidal walls which define a rectangular opening. The tubes of the funnel and flue extend helically and connect each to the other. The funnel tubes in the larger trapezoidal walls have transition portions which are disposed at greater angles to form a smooth transition into the funnel tubes of the smaller trapezoidal walls.

11 Claims, 3 Drawing Figures

SOLID FUEL FIRED VAPOR GENERATOR

This invention relates to a solid fuel fired vapor generator. More particularly, this invention relates to a flue and funnel construction for a solid fuel fired vapor generator.

Heretofore, various types of solid fuel fired vapor generators have been known which employ a vertical gas flue which is rectangular in cross-section. Generally, such flues have been formed of tubes which are welded together in gas tight manner and which convey a working medium therethrough. In addition, it has been known to provide such vertical flues with a funnel which is also formed of tubes which are welded together in gas tight manner and through which the working medium flows. Usually, the funnel has been formed of a combination of four plane walls which define a rectangular outlet opening at the bottom end. Further, the flue tubes and the funnel tubes have been interconnected and disposed helically about the vapor generator in order to convey the working medium.

In one known vapor generator of the above type for example, as described in U.S. Pat. No. 3,832,978, the funnel has been formed of two opposite vertical trapezoidal walls and two opposite inclined rectangular walls so that a rectangular outlet opening at the bottom end of the walls has the same length as the length of each inclined rectangular walls. The two vertical trapezoidal walls therefore form aligned prolongations of the two parallel walls of the flue and each bound a short side of the rectangular outlet opening at the bottom end. Because of the simple design and simplicity of construction, this vapor generator has generally proved satisfactory in practice. In particular, this type of generator simplifies adaptation of the width of the outlet opening to the requirements of the various devices used for ash removal. However, the length of the outlet opening must be taken into consideration when the ash removal means are being designed. This complicates the erection of plants which employ vapor generators of this type since the plants are conventionally assembled from standard parts.

Accordingly, it is an object of the invention to provide an improved vapor generator which simplifies the design and construction of ash delivery facilities disposed at a bottom end of the vapor generator.

It is another object of the invention to provide an improved vapor generator construction which can be assembled from standard parts.

It is another object of the invention to standardize the outlet opening from a vapor generator for ash removal purposes.

Briefly, the invention provides a solid fuel fired vapor generator which is comprised of a vertical gas flue having a rectangular cross section and a funnel disposed at a bottom end of the flue. The flue includes a plurality of working medium-carrying tubes which define a plurality of walls, for example being welded together in gas tight manner. The funnel is also formed of a plurality of helically extending tubes which are connected to the flue tubes to convey working medium therebetween. In addition, the funnel tubes define four plane trapezoidal walls and a rectangular outlet opening at a bottom end of the funnel walls.

Since all of the funnel walls are trapezoidal, the length of the outlet opening at the bottom of the funnel can be adapted to the ash delivery facilities or devices.

This enables the ash delivery facilities or devices to be readily assembled from standard parts. This has been found to be more economical than the conventional procedure of adapting the ash removal facilities to the outlet opening.

The above construction of the vapor generator is particularly advantageous where an oil fired vapor generator is being converted to a coal firing vapor generator.

The tubes in each of the funnel walls are disposed at a uniform distance with respect to each other. To this end, the tubes in the trapezoidal walls defining the long side of the retangular opening have a transition portion which is disposed on a different angle from the remainder of the tubes in order to merge into the tubes of the trapezoidal walls defining the short sides of the outlet opening.

These and other objects and advantages of the invention will become more apparent from the following detailed description taken in conjunction with the accompanying drawings wherein.

Figure 1:
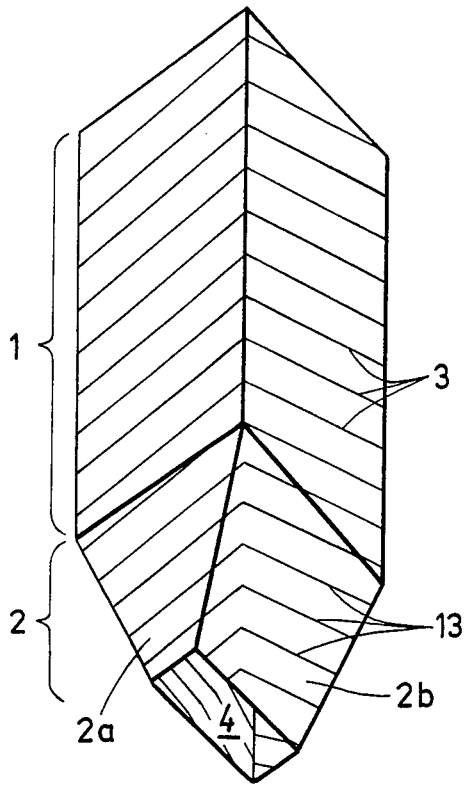
FIG. 1 illustrates a perspective view of a vapor generator constructed in accordance with the invention.
Figure 3:
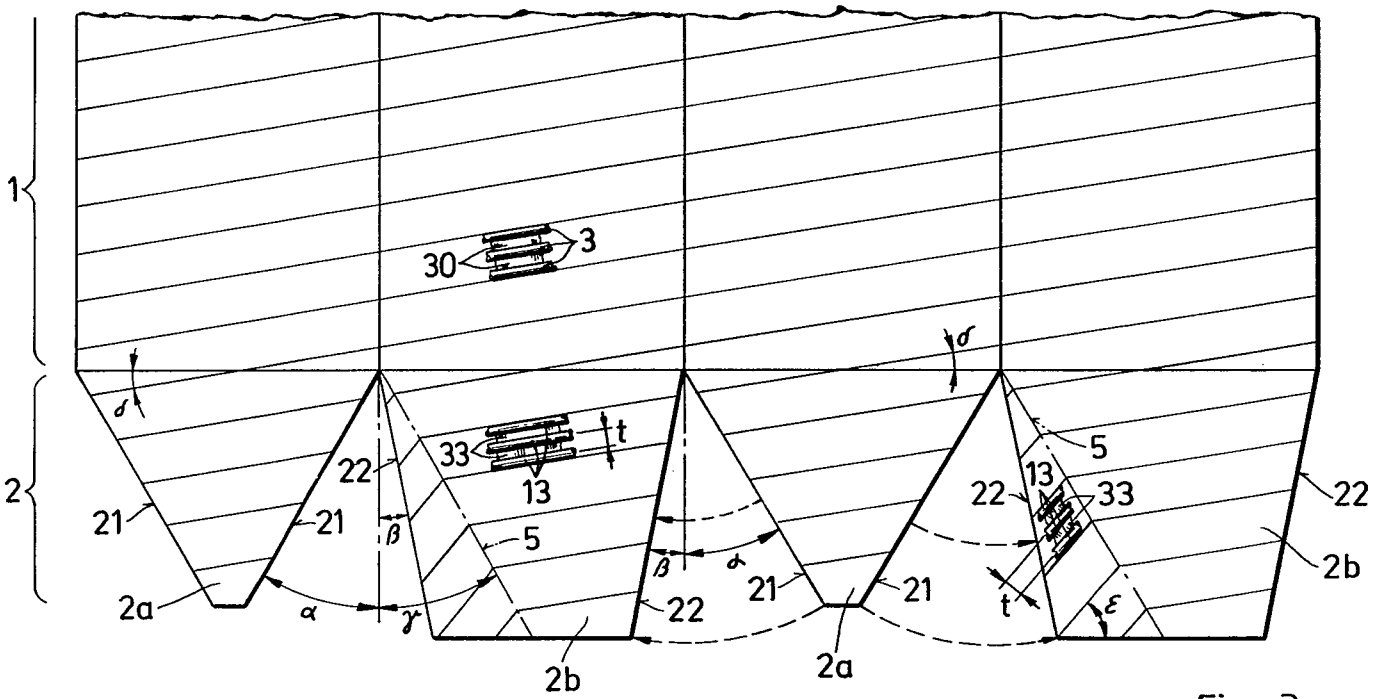
FIG. 3 illustrates a developed view of the vapor generator of FIG. 1.

Referring to FIG. 1, the vapor generator has a vertical gas flue 1 of rectangular cross-section and a funnel 2 which is disposed at the bottom end of the flue 1. The flue 1 is formed of a plurality of working medium carrying tubes 3 which are welded together in gas tight manner by way of webs 30 as indicated in FIG. 3 in order to define a plurality of vertical walls namely four walls. As indicated in FIG. 1, the tubes 3 extend helically about the flue 1.

The funnel 2 is also formed of tubes 13 which are welded together in gas tight manner by way of webs 33 as indicated in FIG. 3 with the tubes extending helically about the funnel 2. These tubes 13 are connected to the flue tubes 3 in order to convey working medium therebetween.

Figure 2:
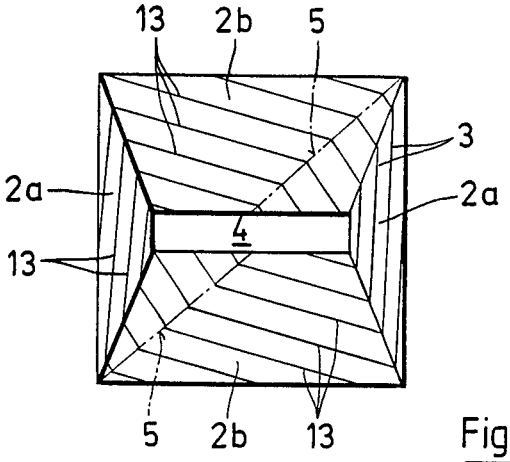
FIG. 2 illustrates a plan view of the vapor generator of FIG. 1.

Referring to FIG. 3, the funnel tubes 13 define four plane trapezoidal walls which bound a rectangular outlet opening 4 at the bottom end as indicated in FIGS. 1 and 2. Two of the inclined walls 2*a* bound the short sides of the retangular opening 4 while the remaining two trapezoidal walls 2*b* define the long sides of the outlet opening 4.

The working medium which flows through the tubes 3, 13 is supplied at the bottom end of the funnel tubes 13 and is removed at the top end of the flue tubes 3, i.e. the medium flows upwardly. Coal dust burners (not shown) are also disposed in known manner near the vertical edges of the flue 1 and are operative to provide a tangential firing of the vapor generator.

Referring to FIG. 3, the inclined edges 21 of the walls 2*a* each form an angle $\alpha$ with the vertical while the inclined edges 22 of the funnel walls 2*b* include an angle $\beta$ with the vertical. That is, each of the larger trapezoidal walls 2*b* is in a plane which forms an angle $\alpha$ with a vertical plane while the smaller trapezoidal walls 2*a* are in planes which define an angle $\beta$ with a vertical plane.

The tubes 13 in the smaller walls 2*a* are also disposed at an angle $\delta$ to the horizontal with a major portion of each tube 13 of the larger funnel walls 2*b* also being disposed in the same angle. As indicated, each tube 13 of the large trapezoidal walls 2*b* also have a transition position disposed on an angle $\epsilon$ to a horizontal and extends in FIG. 3 between the left inclined edge 22 of the wall to a straight boundary line 5 which extends from an intersection of the inclined edge 22 with a point between the flue 1 and the funnel 2. As indicated, this boundary line 5 forms an angle $\gamma$ with a vertical plane.

As as indicated in FIG. 3, the inclined angle $\epsilon$ of the transition portions of the funnel tubes 13 is greater than the helical angle $\delta$ of the remaining portions of the tubes 13 in the trapezoidal walls 2*b*. A continuous transition is therefore ensured between the tubes 13 of the larger funnel walls 2*b* and adjacent smaller trapezoidal walls 2*a*.

In order to ensure a constant spacing t between the individual tubes 13 in the whole funnel 2, the above-noted angles have the following relationships to one another.

$$\beta=\alpha-2\delta$$

$$\gamma=\alpha$$

$$\epsilon=2\alpha-\delta$$

The angle $\alpha$ is 30° in FIG. 3—i.e. the angle is below the critical value of 35° at which tough combustion residues, particularly ash, still flow staisfactorily through the funnel 2.

Since the walls 2*a* bounding the short sides of the opening 4 also extend on an incline, it is a simple matter in the designing of the vapour producer to adapt the length of the opening 4 to the facility (not shown) which flows the aperture 4 and which is operative to deliver the combustion residues. Such facilities can then be readily assembled from standard parts.

Alternatively, the gas flue 1 can have a rectangular cross-section other than a square cross-section as shown.

What is claimed is:

1. A solid fuel fired vapor generator comprising a vertical flue having a rectangular cross-section, said flue including a plurality of working medium-carrying tubes defining four vertical walls; and a funnel disposed at a bottom end of said flue and including a plurality of helically extending tubes connected to said flue tubes to convey working medium therebetween and defining four inclined plane trapezoidal walls and a rectangular outlet opening at a bottom end of said plane walls.

2. A vapor generator as set forth in claim 1 wherein an inclined edge of a trapezoidal wall bounding a short side of said outlet opening forms a first angle ($\alpha$) with a vertical;

an inclined edge of a trapezoidal wall bounding a long side of said outlet opening forms a second angle ($\beta$) with a vertical;

said funnel tubes are disposed at a third angle ($\delta$) to a horizontal with a transition portion of each said funnel tube in each trapezoidal wall bounding a long side of said outlet opening being disposed on a fourth angle ($\epsilon$) to a horizontal in a transition zone extending between an inclined edge of said trapezoidal wall and a straight boundary line; and wherein each said straight boundary line forms a fifth angle ($\gamma$) with a vertical.

3. A vapor generator as set forth in claim 2 wherein said second angle ($\beta$) is equal to said first angle ($\alpha$) less twice said third angle ($\delta$); said fifth angle ($\gamma$) is equal to said first angle ($\alpha$) and said fourth ($\epsilon$) is equal to twice said first angle ($\alpha$) less said third angle ($\delta$).

4. A vapor generator as set forth in claim 3 wherein said first angle ($\alpha$) is at most 35°.

5. A vapor generator as set forth in claim 1 wherein said flue tubes extend helically and merge directly into said funnel tubes.

6. A vapor generator as set forth in claim 1 wherein each trapezoidal wall defining a long side of said outlet opening defines a first angle ($\alpha$) with a vertical plane of at most 35°.

7. A vapor generator as set forth in claim 6 wherein said angle is 30°.

8. A vapor generator as set forth in claim 6 wherein each trapezoidal wall defining a short side of said outlet opening defines a second angle ($\beta$) with a vertical plane less than said first angle ($\alpha$).

9. A vapor generator as set forth in claim 8 wherein each tube in each trapezoidal wall defining a short side of said outlet opening is disposed on a third angle ($\delta$) wherein said second angle ($\beta$) is equal to said first angle ($\alpha$) less twice said third angle ($\delta$).

10. A vapor generator as set forth in claim 9 wherein each tube in said trapezoidal wall defining a long side of said outlet opening has a main portion on a fourth angle ($\epsilon$) to a horizontal equal to twice said first angle ($\alpha$) less said third angle ($\delta$).

11. A vapor generator as set forth in claim 10 wherein each transition portion extends between an inclined edge of said respective trapezoidal wall and a straight boundary line extending from an intersection of said edge with a point between said flue and said funnel on a fifth angle ($\gamma$) to a vertical plane equal to said first angle ($\alpha$).

* * * * *